US006817801B1

(12) United States Patent
Colburn et al.

(10) Patent No.: US 6,817,801 B1
(45) Date of Patent: Nov. 16, 2004

(54) AUTOMOTIVE INTERIOR LIQUID APPLICATOR

(75) Inventors: Todd Colburn, La Jolla, CA (US); Frederick Large, Carlsbad, CA (US); Brooke T. Baxter, Milford, CT (US); Wen-Chen Su, Lexington, KY (US); Dan Anderson, Carlsbad, CA (US); William R. Bucknam, Jr., Woodbury, CT (US)

(73) Assignee: The Valvoline Company, a division of Ashland, Inc., Lexington, KY (US)

( * ) Notice: Subject to any disclaimer, the term of this patent is extended or adjusted under 35 U.S.C. 154(b) by 0 days.

(21) Appl. No.: 10/437,762

(22) Filed: May 14, 2003

(51) Int. Cl.[7] ..... B43K 5/00

(52) U.S. Cl. ..... 401/205; 401/6; 401/204; 401/263

(58) Field of Search ..... 401/6, 11, 126, 401/130, 196, 203–205, 207, 261, 263

(56) References Cited

U.S. PATENT DOCUMENTS

| | | | | |
|---|---|---|---|---|
| 1,287,487 | A | | 12/1918 | Smith |
| 1,565,608 | A | | 12/1925 | Walsh, Jr. |
| 1,678,962 | A | | 7/1928 | Stark et al. |
| 1,972,318 | A | | 9/1934 | Rosenberg |
| 2,147,769 | A | | 2/1939 | Epstein |
| 2,377,837 | A | | 6/1945 | Zimmerman |
| 2,946,154 | A | | 7/1960 | Bornemann |
| 3,006,023 | A | | 10/1961 | Worthington |
| 3,324,855 | A | | 6/1967 | Heimlich |
| 3,418,059 | A | | 12/1968 | Robe |
| 3,876,314 | A | | 4/1975 | Nehring |
| 4,035,090 | A | | 7/1977 | Bavaveas |
| D245,390 | S | | 8/1977 | Hoyt |
| 4,084,910 | A | | 4/1978 | LaRosa |
| 4,148,318 | A | | 4/1979 | Meyer |
| 4,183,684 | A | | 1/1980 | Avery, Jr. |
| 4,225,254 | A | | 9/1980 | Holberg et al. |
| 4,601,081 | A | | 7/1986 | Sutton et al. |
| 4,762,433 | A | | 8/1988 | Bergeson et al. |
| 4,983,061 | A | | 1/1991 | Demarest |
| 5,064,306 | A | | 11/1991 | Gueret |
| 5,122,056 | A | | 6/1992 | Barbee |
| 5,307,847 | A | | 5/1994 | Pavenick et al. |
| 5,397,194 | A | | 3/1995 | Yuan et al. |
| 5,452,961 | A | * | 9/1995 | Lu ..... 401/42 |
| 5,597,255 | A | | 1/1997 | Yager et al. |
| 5,755,241 | A | | 5/1998 | Cheung |
| 5,775,826 | A | | 7/1998 | Miller |
| 5,791,801 | A | | 8/1998 | Miller |
| D405,572 | S | | 2/1999 | Bouchez |
| 5,896,616 | A | | 4/1999 | Large |
| 5,904,433 | A | | 5/1999 | Kay |
| 5,987,694 | A | | 11/1999 | Large |
| 6,010,268 | A | | 1/2000 | Sereg et al. |
| 6,035,806 | A | | 3/2000 | Lorenzo |
| 6,092,952 | A | | 7/2000 | Eberle |
| 6,095,705 | A | | 8/2000 | Phillips |
| 6,135,659 | A | | 10/2000 | Ku |
| D434,525 | S | | 11/2000 | Angeletta |
| 6,371,675 | B1 | * | 4/2002 | Hoang et al. ..... 401/205 |
| 6,425,701 | B1 | * | 7/2002 | Jacobs ..... 401/6 |
| D461,279 | S | | 8/2002 | Angeletta |
| 6,547,471 | B1 | | 4/2003 | Tucker et al. |

OTHER PUBLICATIONS

Photograph Copy—Quick N' Neat Liquid Wax Applicator, Clean Shot Products, Inc., Emporia, KS 66801–(5 pages).

* cited by examiner

*Primary Examiner*—Tuan Nguyen
(74) *Attorney, Agent, or Firm*—Fulwider Patton Lee & Utecht

(57) ABSTRACT

An applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

39 Claims, 7 Drawing Sheets

22
24
26
15
67
86
32
31
87
27
70
69
98
58
55
68
57
56
75
76
62

15
87
22
24
26
27
67
70
88
69
31
86
32
87
68
57
28
85
75
76
80
56
55
62

67
15
22
70
86
26
27
24
81
58
69
7
88
7
87
32
31
57
58
80

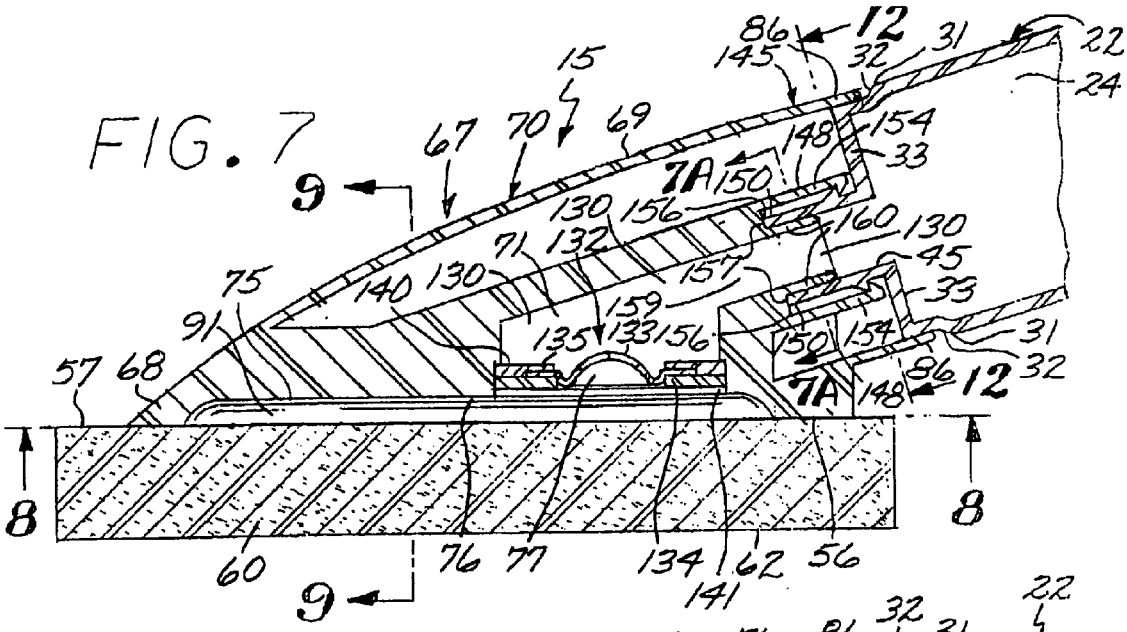
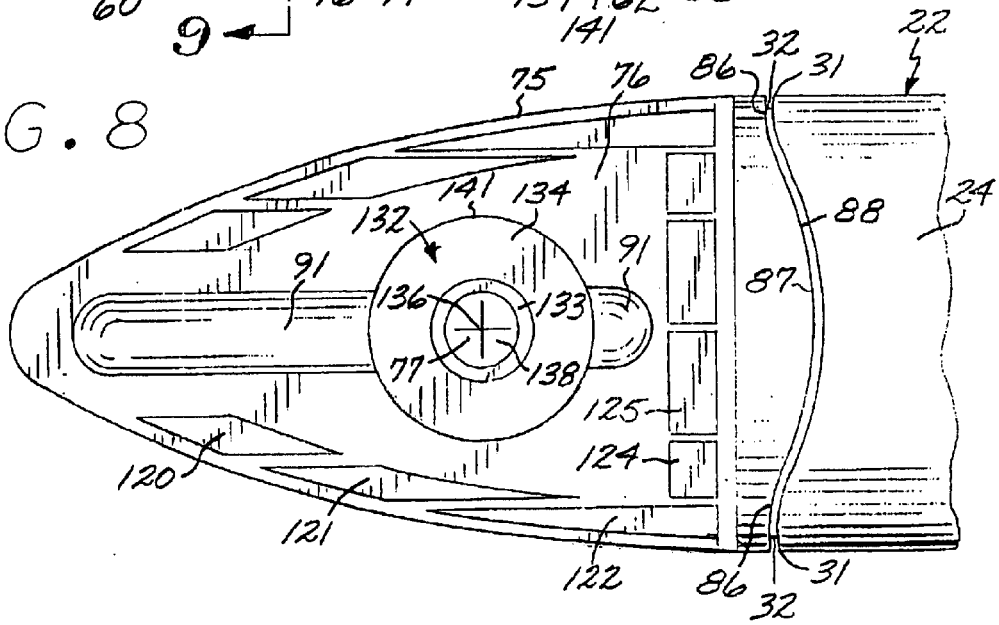
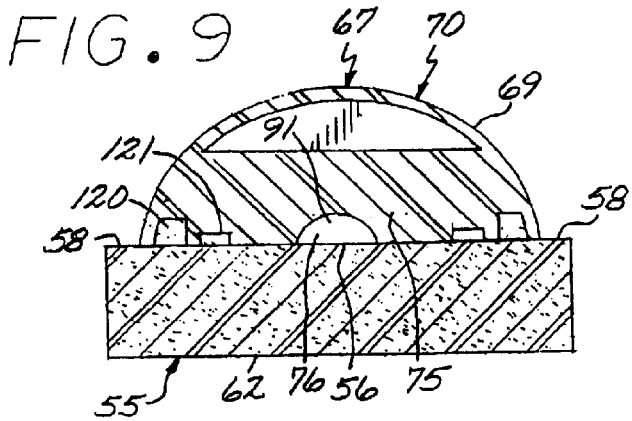
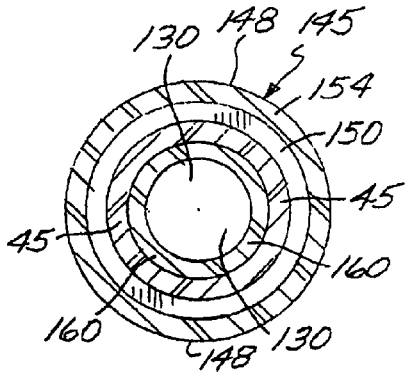
FIG. 7A

AUTOMOTIVE INTERIOR LIQUID APPLICATOR

BACKGROUND OF THE INVENTION

1. Field of the Invention

The present invention relates to an applicator device for conveniently and effectively applying cleaning and other treatment fluids to a variety of surfaces, such as a dashboard or the many other upholstery surfaces found in the interior of an automobile.

2. Description of Related Art

Automobile and other vehicle owners often use various cleaning, polishing and other appearance maintenance substances to enhance and preserve the internal appearance of their vehicles. These substances may be found in a multiplicity of chemical compositions assuming several forms, and will generally be sprayed or squeezed from their container directly onto the surface to be treated or onto a simple applicator device such as a rag or sponge. Such devices, however, have their disadvantages. For instance, a used rag soaked with treatment liquid must be either discarded or laundered after use. Laundering may prove to be time consuming and expensive, and discarding the rag and purchasing a new one for each use can be inconvenient, cost prohibitive and detrimental to the environment. Also, traditional applicator devices, such as sponges or rags, are not easily or efficiently manipulated by the user, and are often not shaped to conform to and reach the many and varied contours and crevices in an automobile interior.

Cleaning or other treatment fluids often come in contact with the user's hands, causing them to be dirtied or otherwise harmed by such contact. A sponge, when gripped, may also become distorted in the middle to curve upwardly at the sides as the user squeezes it or attempts to apply controlled and focused pressure to a certain spot, resulting in an uneven and distorted contact surface that negates the smooth flow and even application of substance being applied. Furthermore, with traditional sponges or rag applicators, the user must periodically apply cleaning or treatment fluid to the applicator.

Many devices have been developed for applying polishing, waxing, cleaning or other treatment compounds to a surface. However, without a handle or other design measures to assist the user in focusing and controlling the amount and magnitude of his or her treatment or cleaning efforts, traditional applicator devices have proven to be inconvenient and inefficient, especially for treatment of automobile upholstering or dash boards. What adds to the challenge of applying these fluids to the interior surfaces of a automobile is the fact that such surfaces are often formed in recesses or are configured with compound curvatures, angles and crevices of various shapes and sizes that challenge the effective and sustained access and control achievable with conventional applicators. For example, when using many traditional applicators, a user may encounter significant difficulty when attempting to apply treatment fluid to the portion of an automobile dashboard that is directly adjacent to its intersection with the rearwardly sloped windshield. Additionally, without a readily accessible resupply of such cleaning or treatment fluid, even with easily reachable surfaces, continuous re-application of fluid to the treatment surface or applicator device leads to inefficient expenditure of a user's time and energy. Therefore, an applicator device is needed that can provide for a steady, prolonged and efficient flow of treatment fluid that is well distributed across the lateral and longitudinal dimensions of the working surface, but that is also capable of reaching the totality of the surfaces found in an automobile's interior.

Several prior art devices have proposed the basic concepts of a porous applicator fixably mounted to some type of a container having a reservoir or breakable bladder to hold the fluid to be applied therein. The fluid contained within the container of these devices is absorbed into the porous applicator, and the applicator is then applied to a solid surface to distribute the fluid thereon. Because such devices often lack the requisite dispensing capabilities for controlled amounts of fluid over an extended surface area of the applicator pad, they often simply serve to distribute fluid to a central location on the pad, which may result in a concentration of fluid in its center and an insufficient amount at the forward, rear and lateral extremities thereof. Furthermore, the contact surfaces of the applicator pads of such devices are often not adapted to conform to and/or reach the wide array of surfaces found in a conventional automobile, and such devices may be unsuitable or unadaptable for application of different fluids that are designed for use with differing types of respective surface materials, such as leather, vinyl and the like. In addition, the relatively small surface area of some such applicators may make application to an automobile time consuming and laborious.

In recognition of some of the aforementioned shortcomings, a wax applicator has been proposed which includes a flat applicator plate having a central opening therein and a porous pad mounted thereunder and formed with a centrally disposed communication opening. A cylindrical handle forms a liquid wax receiving container and is formed on one end with a coupling plate. The coupling plate is formed with a central opening alignable with the openings in the applicator plate and pad. A domed valve is mounted over such outlet opening to, upon compression of the walls of the handle, release charges of liquid wax to be dispensed directly through the opening in the pad to the underlying surface to be waxed. A device of this type is marketed under the trademark Quick n' Neat™ by Clean Shot Products Co., of Emporia, Kans. Such devices fail to provide for distribution of the dispensed liquid throughout the surface of the applicator pad thus inhibiting efforts to provide for broad, uniform application of treatment fluid, and require a certain degree of dexterity and effort to reach and properly apply treatment fluid to the less accessible interior areas of a typical automobile.

A need exists in the marketplace for an applicator device capable of sustained and controlled application of a desired treatment fluid in a uniform manner to the many and varied surfaces found in the interior of an automobile. It would also be especially beneficial if the housing that mounts the applicator's pad was designed for rapid and secure mating with a complementally designed replaceable container. The present invention fulfils this need.

SUMMARY OF THE INVENTION

Briefly and in general terms, the present invention is directed to an applicator device for spreading and applying cleaning, protecting or other treatment fluids to a wide array of variously shaped and dimensioned surfaces, such as those found in the interior of an automobile. The applicator device includes a container enclosing a reservoir having a ready supply of treatment fluid that also serves as a handle by which the user grasps the applicator device.

Joined to the container is a complementally mating applicator head comprising an applicator pad and a dispenser housing including a flow chamber and a bottom distribution plate, to which the applicator pad is affixed or otherwise attached. In one preferred embodiment, the fluid is transferred through the housing to an attachment surface of the applicator pad. The distribution plate includes a distribution surface formed with at least one distribution channel, which may also or alternatively be correspondingly formed on the applicator pad attachment surface, that then facilitates the flow of fluid to various desired portions of the applicator pad. Such distribution may also be achieved by passages or channels formed in a plate or the like sandwiched into the interface between the distribution plate and the pad. In another permutation, the flow chamber works in conjunction with a plurality of dispensing openings arrayed about the distribution plate to dispense the fluid of the container to the applicator's pad for further transfer therethrough to the pad's working surface. In another permutation, the housing may include a central manifold from which distribution channels extend outwardly and forwardly to distribute the fluid across the width and length of the applicator's pad.

For joining the container to the applicator head, various configurations are contemplated, and in one preferred embodiment, the dispenser housing includes a somewhat funnel shaped upwardly and rearwardly opening cowling disposed about an inlet device, with the inlet device further including a coupling shell for releasably receiving the neck of the container by way of a snap lock, bayonet fit, threaded engagement or other appropriate connection. The housing is configured with its inlet device and cowling angling upwardly and rearwardly at a predetermined angle to the distribution plate such that the elongated body of the container projects longitudinally of the inlet device at the same predetermined angle when the container is coupled to the housing. When so configured, the container, inlet, flow chamber and distribution plate cooperate to form a fluid communication path therethrough to the applicator pad. A flow control, which in one preferred embodiment is in the form of a one way valve, is positioned at some point along this communication path to regulate the flow of fluid to the applicator pad.

The present invention may take the form of several embodiments designed for application of treatment and cleaning fluid to a variety of interior surfaces as may be found in an automobile, and may be adapted for each by, for example, modifying the surface area, shape and material composition of the applicator pad, or the material composition of the fluid in the container. In a preferred embodiment, the applicator pad is generally flat iron shaped, having similar dimensions to those of the housing's distribution plate, and may be formed with a forwardly projecting flexible finger to further facilitate the application of fluid to hard to reach surfaces.

In a related aspect of the invention, the lateral edges of the outer perimeter of the applicator pad may extend laterally outwardly from the distribution plate, and may be oriented generally transversely to the longitudinal axis of the pad's attachment and working surfaces. However, it is also contemplated that the sides of the applicator pad may angle downwardly and outwardly from the attachment surface to culminate in a working surface having a similar general shape, but a relatively greater surface area than that of the attachment surfaces of the applicator pad and the housing's distribution plate. In yet another preferred embodiment, the side walls of the dispenser housing may be formed on their lower extremities with respective laterally projecting side wings to define a distribution plate of relatively greater surface area than in the above described embodiment.

In one preferred embodiment, the container may be disposable and replaceable, being produced in multiple variants adapted to contain any number of specific use fluids, such as those designed for cleaning or treating vinyl, leather and the like. However, it is also contemplated that the container may be refillable by a filling stem projecting outwardly from its proximal end.

In still another preferred embodiment seeking to emphasize a comfortable interaction with the hand of the user, the container may be formed with at least an ergonomically adapted dorsal wall designed to be complementally received in the user's palm, and may include finger grooves for receipt of the fingers of the user's grasping hand. Also in keeping with the invention, the container may take the form of a squeeze tube or other appropriate structure formed with flexible walls, whereby squeezing of the walls urges the flow of fluid along the fluid communication path, through the flow control, and to the applicator pad. In another possible aspect of the invention, the container may be formed with rigid walls requiring the user to elevate the container above the level of the dispenser housing to initiate fluid flow through the housing.

These and other features and advantages of the applicator device will become apparent from the following detailed description of preferred embodiments which, taken in conjunction with the accompanying drawings, illustrate by way of example the principles of the invention.

BRIEF DESCRIPTION OF THE DRAWINGS

FIG. 7 is a longitudinal sectional view, in enlarged scale, taken along line 7—7 of FIG. 3;

FIG. 7*a* is a transverse sectional view, in enlarged scale, taken along line 7A—7A of FIG. 7;

FIG. 8 is a horizontal sectional view taken along line 8—8 of FIG. 7;

FIG. 9 is a vertical sectional view taken along line 9—9 of FIG. 7;

DETAILED DESCRIPTION OF THE PREFERRED EMBODIMENTS

Figure 1:
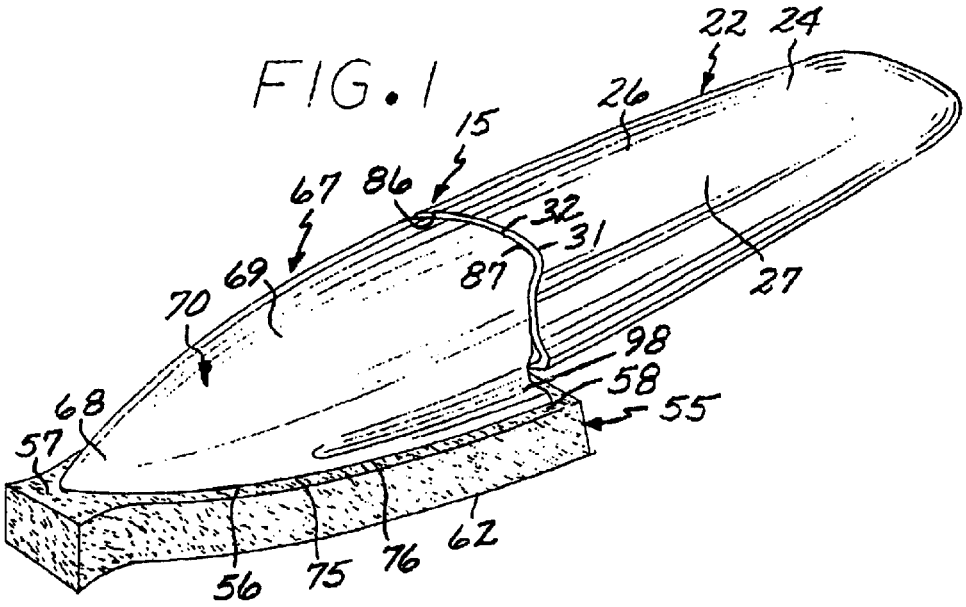
FIG. 1 is a perspective broken view of an applicator device embodying the present invention.

Referring to FIGS. 1–3, and 7–9, the applicator device 15 of the present invention includes, generally, an applicator head 67, which includes a dispenser housing 70 and an applicator pad 55, and a container 22, which in a preferred embodiment both defines a container reservoir 24 for storing fluid and serves as an elongated handle. With continued reference to FIGS. 7 and 8, the applicator head 67 includes a housing 70 formed with a bottom distribution plate 75, which includes a distribution surface 76. The housing 70 further includes a flow chamber 71 and a container coupling assembly 145 including an inlet device 148 projecting rearwardly from the flow chamber for coupling with the container 22 to secure the container to the housing 70. The inlet device 148 may take on any convenient shape or form for transferring fluid therethrough to the flow chamber 71, and, as depicted in the preferred embodiment of FIG. 7, may include a tubular inlet boss 160 and a coupling shell 154. A flow control device, generally designated 132, for metering the flow of fluid to the applicator pad 55 is interposed at some point along a fluid communication path 130 that extends from the container 22 and through the inlet device 148, flow chamber 71 and distribution plate 75. The pad is mounted on one side on the distribution surface 76 of the distribution plate 75 at an applicator pad attachment surface 56 by any appropriate affixation or bonding means as is well known in the art, and is further formed on the opposite side with a working surface 62 that is adaptable to engage the variety of surfaces found in an automobile interior.

Figure 20:
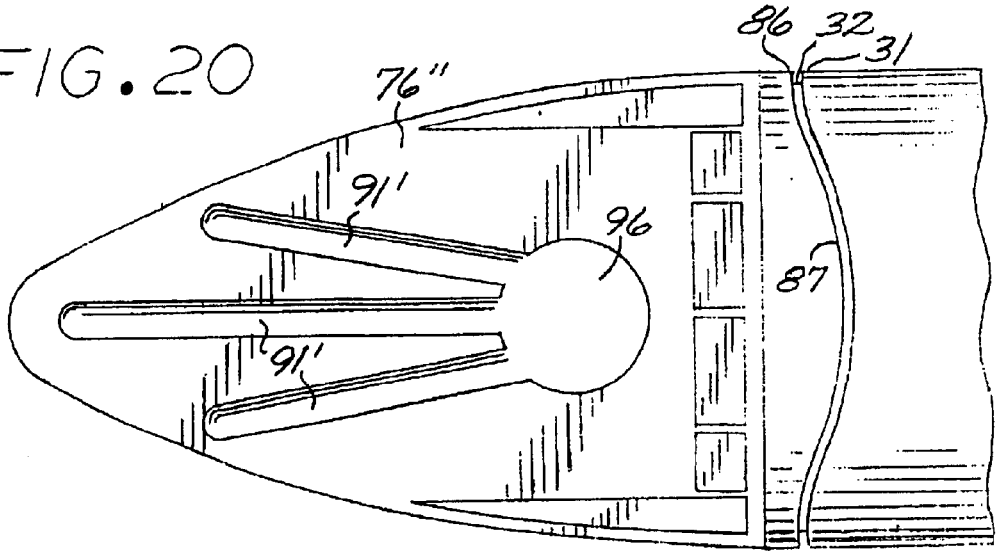
FIG. 20 is a horizontal sectional view of the applicator head of a third embodiment of the applicator device of the present invention.

In the preferred embodiment as depicted in FIG. 7, the distribution plate 75 is generally planar, however, it is contemplated that the plate may be formed with a curved or angled surface as required to be more adaptable to specific correspondingly shaped interior surfaces. The distribution plate 75 is further formed with flow distribution capability, which, as shown in FIGS. 7–8, may include at least one distribution opening 77, providing for communication of fluid from the flow chamber 71 to distribution surface 76, and least one longitudinal distribution channel 91. It is contemplated, however, that this distribution capability may take on any number of forms, such as, for example, the distribution plate 75 being formed with openings to pass the fluid therethrough, slits formed through the plate or in its distribution surface or a sieve type arrangement in the plate. While the preferred embodiment of FIG. 8 depicts one such distribution channel 91, extending longitudinally on both sides of the flow control 132, which is shown as being disposed in the bottom plate 75, it is also contemplated that a distribution plate 75 or distribution surface 76 may be formed with a plurality of such channels 91 extending across its longitudinal and lateral dimensions, or, as shown in FIG. 20, that a distribution surface 76" may be formed with a plurality of channels 91' extending from a central distribution manifold 96. It is further contemplated that the distribution channel or channels 91 (FIG. 8) may be formed with branches extending laterally and outwardly therefrom to facilitate the evenly dispersed flow of fluid across both the lateral and longitudinal area of the corresponding attachment surface 56 of the applicator pad 55.

Figure 21:
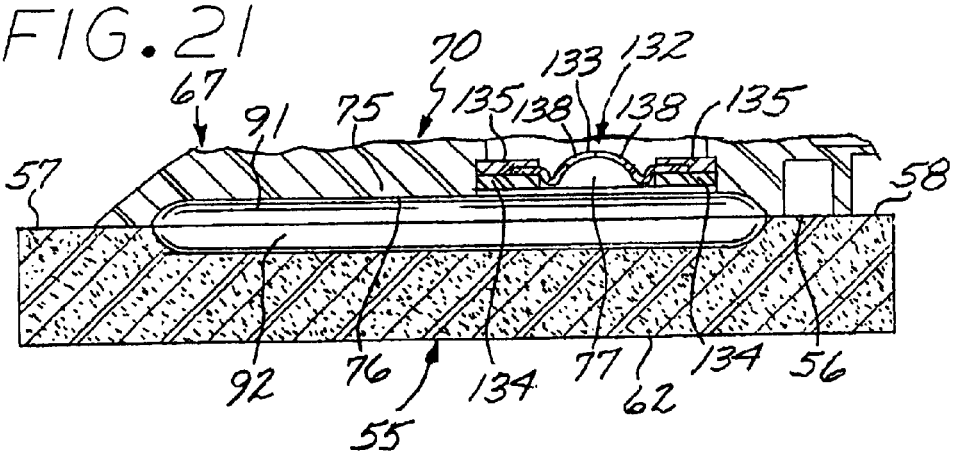
FIG. 21 is a longitudinal sectional view of a modification of the applicator device as shown in FIG. 7.
Figure 22:
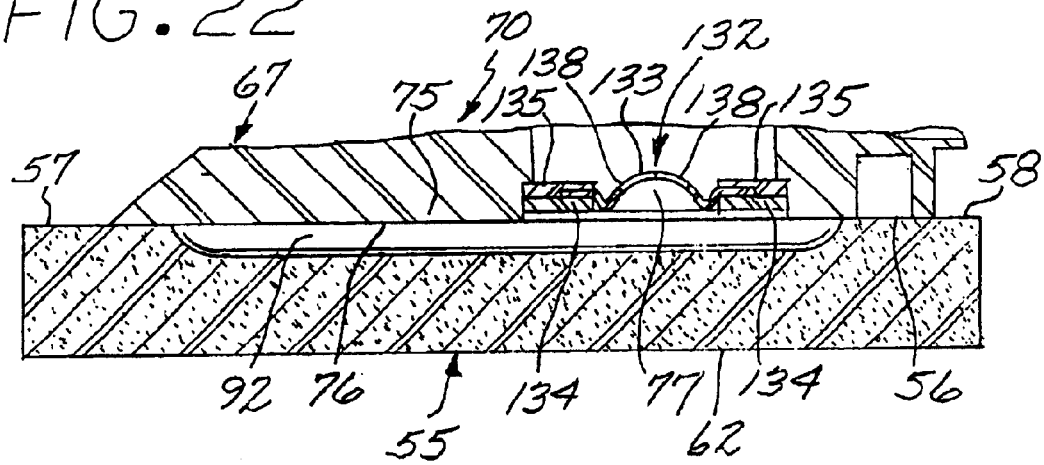
FIG. 22 is a longitudinal sectional view of a modification of the applicator device as shown in FIG. 7.

As shown in FIG. 21, it is also contemplated that the attachment surface 56, on the top side of the applicator pad 55, may also be formed with distribution channels 92 to further facilitate this flow. As shown in FIG. 22, the attachment surface 56 of the pad 55 may be formed with such channels 92 to independently or, in combination with the channels 91 (FIG. 21), serve as the distribution means. Further, while the distribution channels 91 and 92 are preferably formed in the distribution plate or confronting side of the pad, as will be apparent to those skilled in the art, such distribution may also be achieved by passages or channels formed in a plate or the like sandwiched into the interface between such plate 75 and pad 55.

The exemplary applicator pad 55 is of a semi-open cell foam construction and serves to receive fluid from its top side after it passes through the flow control 132 in the distribution plate 75 (FIGS. 7–8). The density of the pad 55 and the viscosity of the fluid is such as to restrict the rate at which the viscous fluid is dispensed therethrough. In practice, after the fluid is deposited on the attachment surface 56, a portion of the fluid will flow through the local area of the pad. The remainder of the deposited fluid will pool on the attachment surface 56 and then travel along the distribution channel 91 to be distributed longitudinally along the center of the pad 55, and laterally through distribution branches if present, for flowing downwardly therethrough to the working surface 62 of the underside of the pad 55.

Figure 23:
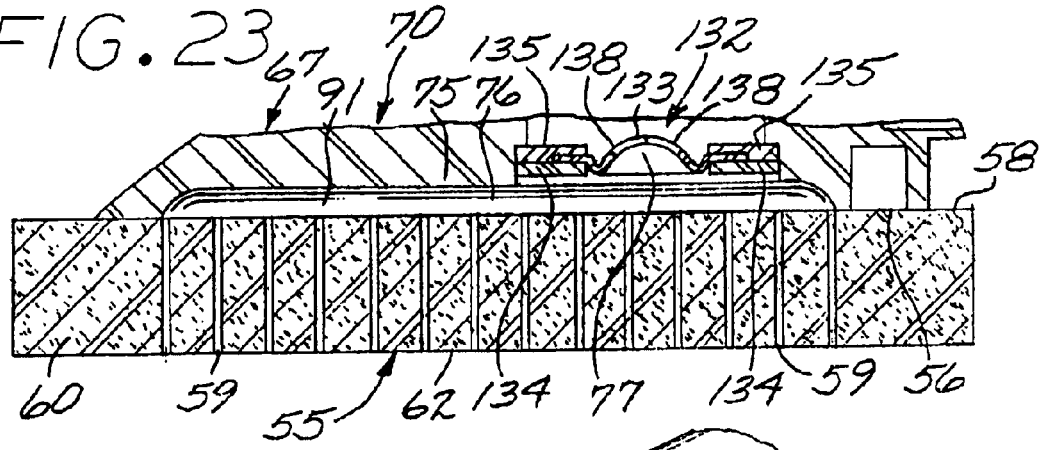
FIG. 23 is a longitudinal sectional view of a modification of the applicator device as shown in FIG. 7.

With reference to the preferred embodiment of FIG. 23, in order to facilitate the transfer of fluid through the applicator pad 55 to specific strategic locations on the working surface 62, the pad 55 may be formed with through channels 59 arrayed thereabout and extending from the attachment surface 56 to the working surface 62 to facilitate even distribution to the working surface 62 of the fluid traveling through the distribution channels 91 and/or 92, or distribution branches. It is also contemplated that pin holes (not shown) punched in the attachment surface 56 may be situated thereon to promote absorption and flow through the pad 55 at specific desired locations, or that the area of the pad not incorporating a distribution channel may also incorporate through channels 59 for passing fluid from the attachment surface 56 to the working surface 62. Additionally, it is also contemplated that, in order to promote a more rapid transfer of fluid through the pad 55 to desired portions of the working surface 62, such as, for example, the lateral extremities of the pad, these desired portions may be formed with pre-cut indentations defining a stepped down transverse cross sectional depth or may be formed from a more porous material than is found in the remainder of the pad 55.

Figure 2:
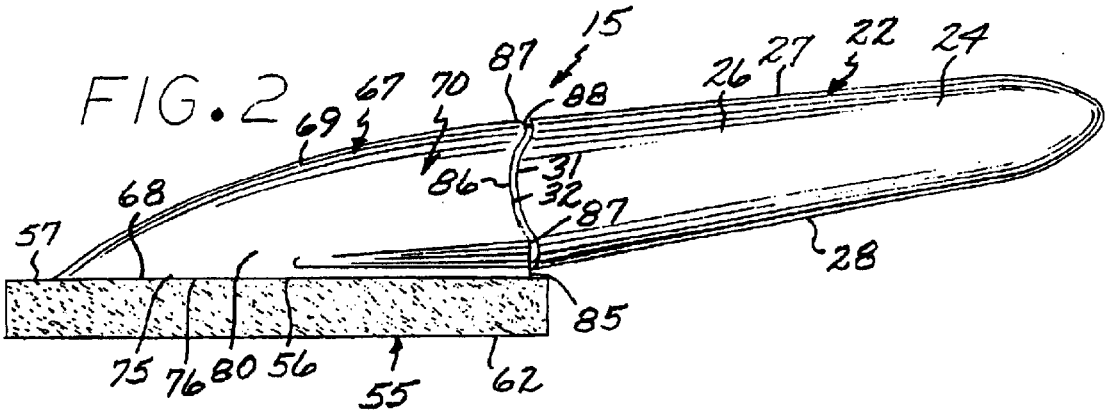
FIG. 2 is a front view of the applicator device shown in FIG. 1.

The applicator pad 55 may take any convenient shape, size and dimensions that are adapted to provide a lower working surface 62 for engagement with the variously dimensioned and shaped interior surfaces of an automobile. As shown in FIGS. 1 and 2, the applicator pad 55 is configured with the attachment surface 56 to be attached to the distribution surface 76 of the distribution plate 75 at an interface therebetween by one of the many suitable bonding agents or other affixation means known in the art. To this end, the distribution surface 76 may be formed with a smooth and solid surface, or may be formed with any appropriate surface pattern, such as a grid or parallel ridges, to provide surface area for bonding the attachment surface 56 of the pad thereto. As shown in FIG. 8, it is also contemplated that the distribution surface 76 may be conveniently formed along its lateral opposite edges with downwardly opening shallow, blind cavities 120, 121 and 122 which act as lightening holes. The rear edge of the distribution surface 76 may also be formed with a row of laterally projecting downwardly opening lightening cavities 124 and 125. The contours of these cavities, which can also take on any convenient shape, dimension and location, cooperate in defining the distribution surface 76 to which the pad 55 is mounted.

The pad 55 is conveniently constructed in the form of semi-open cell polymer sponge like material, which can be either formed by injection molding or cut from a stock of foam such as is well known in the art as being suitable for this purpose. However, while the viscosity of the fluid will influence its rate of flow through the pad 55, it is contemplated that the pad may be formed of any material conducive to providing a desired level of resistance to prevent rapid fluid transfer therethrough to the working surface 62, and that the viscosity and flow characteristics of the fluid, and the requirements of the chosen application, will influence the selection of this material. Therefore, the material composition, shape and dimensions of the pad 55 may be varied to suit a desired application or to work most effectively with the formulation and viscosity of the chosen treatment fluid. For example, it is contemplated that the applicator pad 55 may be formed with semi-open, open or closed cell foam, or with fibers having similar characteristics, or with bristles, such as those found in a brush, or with a porous flow control screen or plate or any other suitable material or structure for passing fluid therethrough to the working surface 62.

Figure 3:
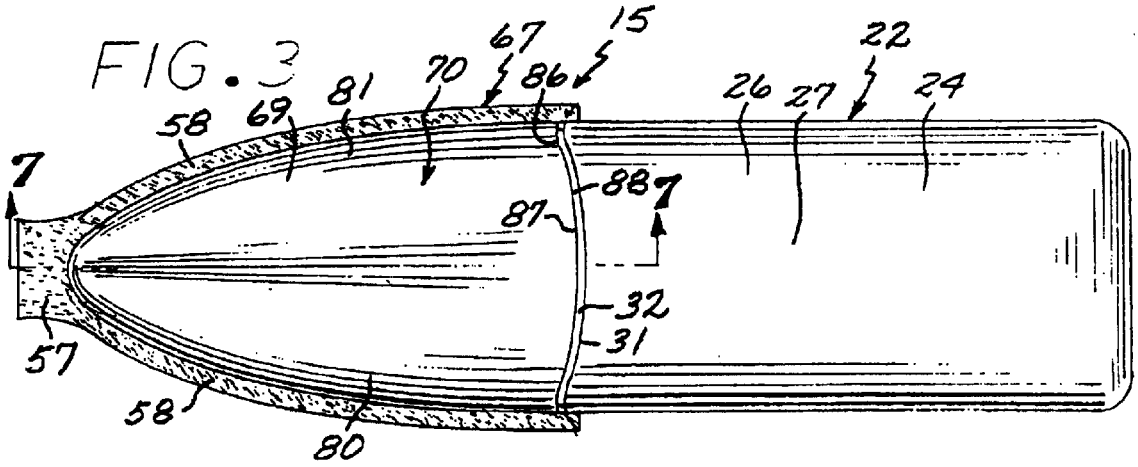
FIG. 3 is a top view of the applicator device shown in FIG. 1.
Figure 4:
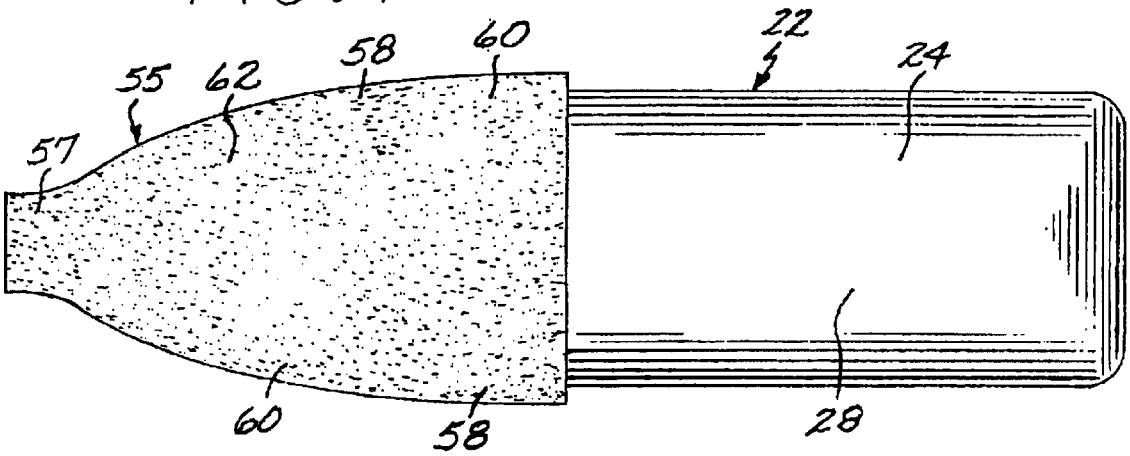
FIG. 4 is a bottom view of the applicator device shown in FIG. 1.

While not essential to the present invention, in the preferred embodiment as shown in FIGS. 1, 3 and 9, the pad 55 is formed oversized relative to the plan view of the distribution plate 75 to project laterally outwardly on opposite sides of such plate to form respective peripheral skirts 58. Further, as shown in FIGS. 1 and 2, it is contemplated that the pad 55 may also project forwardly beyond the distal portion of the housing 70 which defines a nose 68, with this forwardly projecting portion defining a blunt flexible applicator finger 57 to facilitate the longitudinal forward reach of the applicator pad. It is also contemplated that the pad 55 may correspond generally in cross-sectional shape and surface area to that of the distribution plate 75, or that the lateral edges of the pad's outer perimeter may angle downwardly and outwardly to culminate in and define an applicator pad working surface 62 of similar shape to that of the attachment surface 56 and distribution surface 76, but correspondingly greater surface area.

Turning now to the construction of the housing 70, it may take any convenient shape or form, having, for example, an oval, semi-circular or triangular shape, and in a preferred embodiment, is conveniently configured in a somewhat half-bullet nose shape taking on the general appearance of a flat iron, as shown in FIG. 3. It may be formed of any convenient and suitable material, but is preferably formed from polypropylene or of any appropriate molded high density plastic, as are known in the art. The housing 70 has a shell 69 that may include a pair of laterally spaced apart side walls, 80 and 81, and generally defines a somewhat cylindrical transverse cross section. The shell 69 tapers rearwardly and upwardly from the somewhat pointed forwardly disposed nose 68 (see FIG. 2), while angling rearwardly and laterally outwardly to form, at the opposite end from the nose 68, a cowling 86. A housing rear wall extends downwardly from the bottom edge of the cowling 86. For receiving the container 22 in the housing 70, the housing may be formed rearwardly with the coupling assembly 145, which may include the somewhat oval in transverse cross section cowling 86 disposed about the inlet device 148, as shown in FIG. 7. Thus, as is evident from continued reference to FIGS. 2 and 7, the shape of the dispenser housing 70 and applicator pad 55 permits the applicator device 15 to treat many hard to reach surfaces that are not easily reachable by other applicator devices, such as those immediately adjacent to the intersection of an automobile's dashboard with its windshield.

Figure 5:
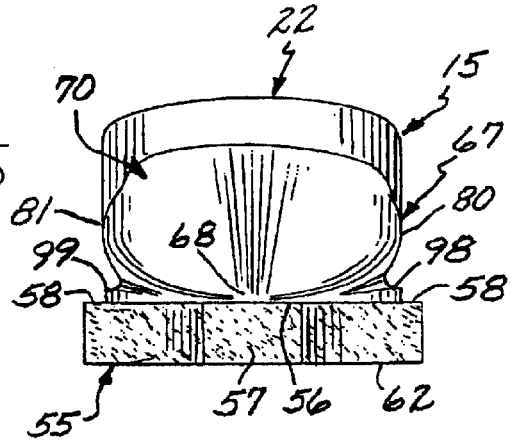
FIG. 5 is a left-hand end view of the applicator device shown in FIG. 1.
Figure 6:
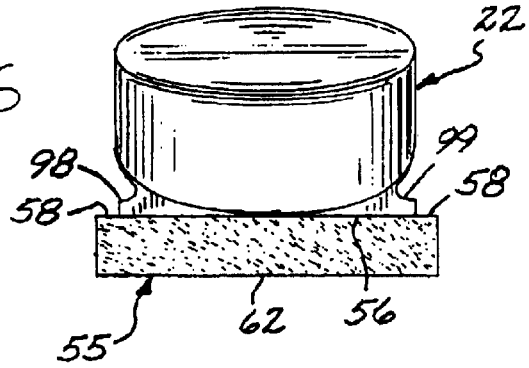
FIG. 6 is a right-hand end view of the applicator device shown in FIG. 1.

It is contemplated that, as shown in FIGS. 1, 5 and 6, the respective side walls 80 and 81 may be formed in the vicinity of their lower proximal extremities with respective laterally projecting side wings, 98 and 99, extending outwardly from the dispenser housing 70 to define a distribution plate 75 of relatively greater surface area for affixation of a correspondingly greater in surface area applicator pad 55 thereto. The design of this embodiment lends greater stability to the applicator pad over an increased surface area, and further facilitates the sustained and inwardly directed application of force by way of the working surface 62 as it is in contact with the automobile interior. While it is contemplated that the user will generally gain favorable purchase of the applicator device 15 by grasping the container 22 as a handle, the side wings 98 and 99 and/or side walls 80 and 81 may provide respective convenient finger grooves or pads that permit the user to grasp the device by the housing 70 and cowling 86 when he or she desires to exert a greater and more focused degree of inwardly directed force to a given treatment surface.

Figure 24:
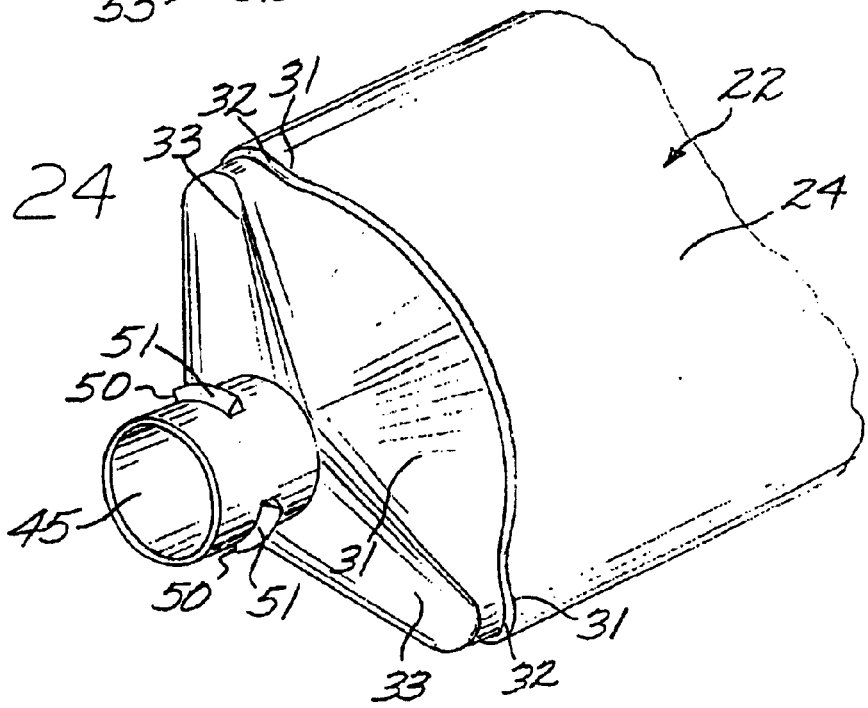
FIG. 24 is a partial perspective view, in an enlarged scale, of the container handle shown included in the applicator device as shown in FIG. 1.

With continued focus on the structure of the housing 70, the coupling assembly 145 may include the rearward portion of the dispenser housing 70 and cowling 86, and is adapted to receive the container 22 therein. As shown in FIG. 24, to be received in the coupling assembly 145, the container may include an end wall 31 and a yoke 33 centrally formed with an outwardly extending neck 45. The coupling assembly 145 may be adapted to receive the neck 45 and yoke 33 while mating with complemental surfaces in the end wall 31 of the container. In one preferred embodiment, as shown in FIG. 7, the inlet device 148 of the coupling assembly 145 projects upwardly and rearwardly to the major surface of the distribution surface 76 of the distribution plate 75 to form an axis at about 20° to the working surface 62 formed by the underside of the applicator pad 55. It is contemplated, however, that this angle may be increased or decreased to optimally promote the flow of fluid from the container 22 through the flow chamber 71 to the applicator pad 55, and may depend on considerations such as the desired application and treatment surfaces and the flow characteristics of the fluid.

Figure 12:
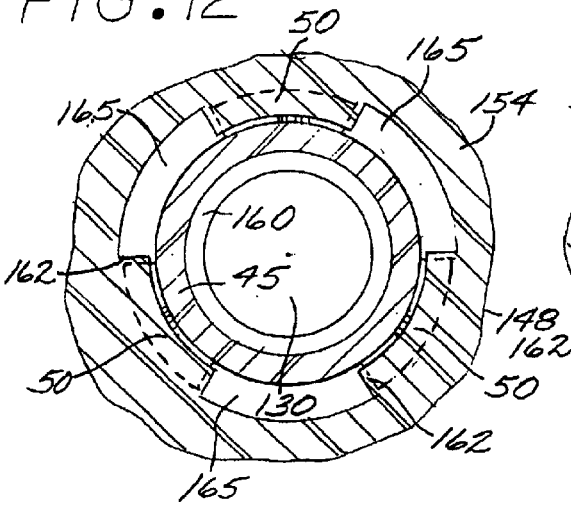
FIG. 12 is a transverse sectional view, in an enlarged scale, taken along the line 12—12 of FIG. 7.
Figure 13:
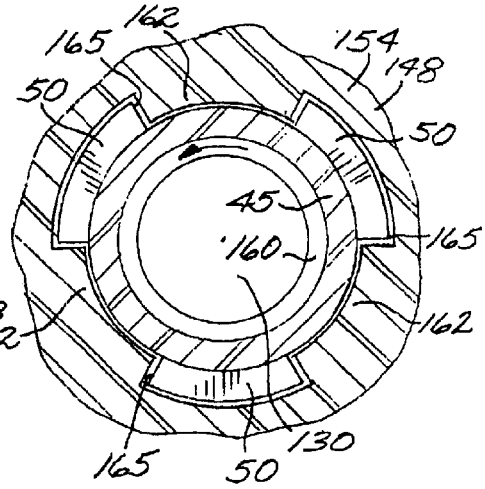
FIG. 13 is a transverse sectional view, in an enlarged scale, taken along the line 12—12 of FIG. 7 similar to FIG. 12.
Figure 14:
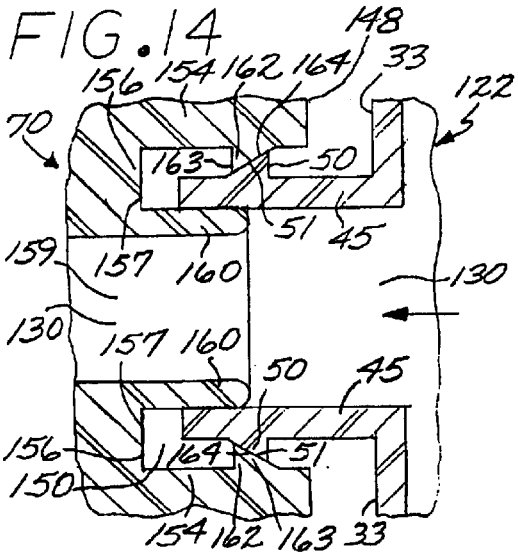
FIG. 14 is a longitudinal sectional view, in an enlarged scale, of a portion of the container coupling assembly included in the device shown in FIG. 7.
Figure 15:
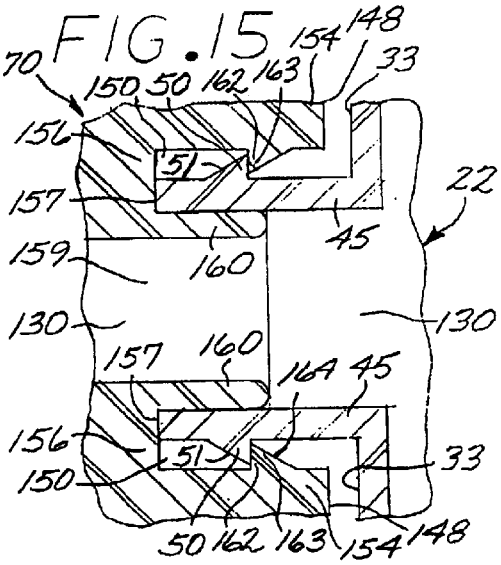
FIG. 15 is a longitudinal sectional view similar to FIG. 14.

As shown in FIGS. 7 and 7*a*, the inlet device 148 may further include the inlet boss 160 extending from flow chamber 71, and may also include a coupling shell 154 disposed concentrically about the inlet boss 160 to form therebetween a rearwardly opening annular cavity 150 for receipt of the neck 45 projecting forwardly from container 22 (see also FIG. 24). The inlet boss 160 is specifically dimensioned to be received within the neck 45 with the neck disposed thereabout in a friction fit relationship. While an annular configuration has been depicted for the cavity 150 to receive the neck, it is contemplated that the cavity 150 may be formed in any convenient and appropriate shape for receipt therein of a corresponding in shape container neck 45. As shown in FIGS. 7, 14 and 15, the inlet device is also formed with a coupling wall 156 that defines an outwardly facing neck abutment surface 157 such that the distal extent of the neck 45 is abutted thereagainst when the neck is received in the annular cavity 150 and telescoped over the inlet boss 160. A central opening 159 (FIG. 7) formed in the coupling wall 156 permits the flow of fluid therethrough to the adjacent flow chamber 71. To operate in conjunction with the structure of the neck 45 to releasably connect the housing 70 to the container 22, as shown in FIGS. 7 and 14–15, the coupling shell 154 of the inlet device 148 is further formed at its distal extremity with a plurality of inwardly projecting lugs 162, which are arrayed thereabout and spaced apart to define respective clearance slots 165 therebetween. For example, in a preferred embodiment depicted in FIGS. 12 and 13, three such lugs 162 are spaced annularly equidistantly apart to define three corresponding clearance slots 165 therebetween.

With the container 22 received in the housing 70, the neck 45, inlet device 148, flow chamber 71, distribution plate 75 and distribution opening 77 cooperate to define fluid communication path 130 therebetween for flow of fluid from the container 22 to the applicator pad 55. Positioned at some point along this fluid communication path 130, a flow control 132 functions to control the flow of fluid therethrough.

Figure 10:
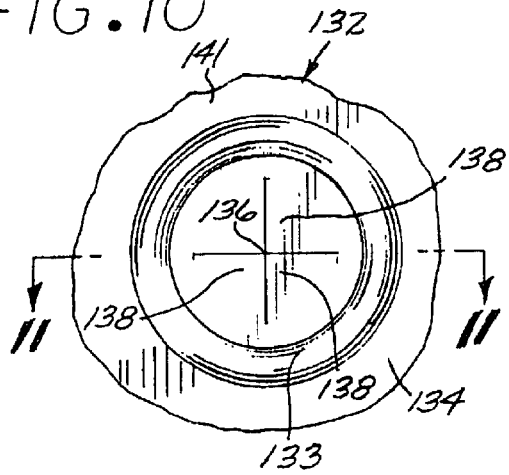
FIG. 10 is a partial horizontal sectional view, in an enlarged scale, of the flow control mechanism shown in FIG. 8.
Figure 11:
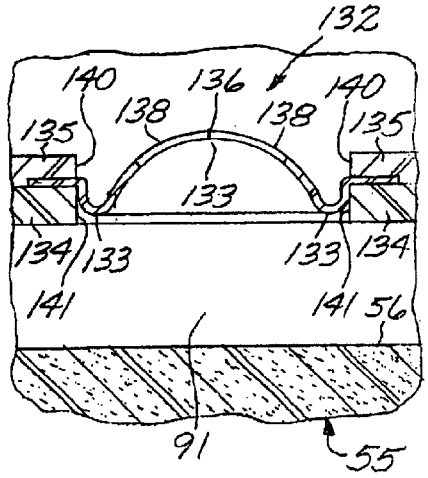
FIG. 11 is a vertical sectional view taken along line 11—11 of FIG. 11.

Referring to a preferred embodiment as shown in FIGS. 7 and 11, the distribution plate 75 may be further formed with a through bore 140 for communicating with the under side thereof. Such bore 140 is counterbored from the bottom at counterbore 141 for nesting there up into the flow control 132. While this nesting may be accomplished by a variety of suitable constructions, in the preferred embodiment as shown on FIGS. 10–11, the flow control 132 includes a pair of mounting rings, 134 and 135, received telescopically in the counterbore 141, that mount centrally therein a control valve 133. While the construction and material composition of the valve 133 may be varied depending on the viscosity of the treatment fluid and the desired flow characteristics for a given application, in the preferred embodiment depicted in FIGS. 10–11, the control valve 133 is a one way flow valve in the form of a flexible polymer sheet configured with a dome having a cruciform slit 136 therein (FIG. 10) to form diametrical slits oriented at 90° to one another to form triangular leaves 138. Upon application of fluid pressure to the top side thereof, radially inward points of these leaves 138 are flexed downwardly and outwardly to cooperate in forming an opening for downward flow of fluid therethrough into the distribution channel 91 and onto the applicator pad attachment surface 56. Upon release of such top side fluid pressure, further flow of fluid through the opening in the valve 133 will be prevented as the leaves 138 return to their original closed configuration.

While a one way valve embodiment has been described, the flow control 132 may take on a variety of forms known in the art, for example a porous disc, duck bill or flapper valve, membrane, other types of valves or any other suitable means for metering the flow of fluid therethrough to a predetermined rate. Also, in the preferred embodiment of FIGS. 7–8, the flow control 132 is disposed in the distribution plate 75, however, it may be located at any other point along the fluid communication path 130 extending from the container 22 to the applicator pad 55 so long as it functions to control the flow of fluid therethrough. For example, the flow control 132 may also be disposed within the inlet boss 160 or situated in the flow path within the flow chamber 71. It is also contemplated that the flow control 132 may be located at the distal extremity of the neck 45, and take the form of any appropriate squeeze bottle type flow control or opening known in the art. Further, the viscosity of the fluid may also influence the chosen construction of the flow control 132. For example, it is known in the art that lower viscosity fluids are more likely to be inhibited from flowing through a one way flow type valve than those fluids having a higher viscosity. Thus, it is contemplated that the specific construction of the flow control 132 may also vary depending on the material composition of the chosen treatment fluid to be dispensed therethrough, as is known in the art.

Focusing now on the container 22, as shown in FIGS. 1 and 2, it includes a dorsal wall 26, a ventral wall 28 and a end wall 31. The container 22 may be multi-purpose in that the distended, self-supporting flexible walls cooperate to define an elongated, somewhat oval in transverse cross-section handle, by which the user may gain favorable purchase of the applicator device 15, while also defining a fluid reservoir 24 containing a supply of cleaning or protecting fluid. In a preferred embodiment as shown in FIGS. 1–3 and 24, the container 22 may take the form of a squeeze bottle formed of a durable yet resilient plastic to form walls to, in their unflexed configuration, maintain the shape and outward dimensions, but compressible inwardly by squeezing to reduce the interior volume to elevate the interior pressure to drive the fluid out into the flow path and distribution network. Being self-supporting, upon release of the squeezing force, such walls will distend to their unflexed positions, thereby drawing a partial vacuum in the reservoir, providing for atmospheric pressure to force air into the reservoir to cooperate with the residual fluid to occupy the full volume thereof. Therefore, it is contemplated that the container 22 may be formed from a multiplicity of appropriate materials encompassing a wide range of durability and resiliency, as are known in the art. For example, polypropylene, polyethylene, polyvinylchloride and the like have proven to be suitable materials for the container 22. The material composition of the container 22 is sufficiently rigid so that it may serve also as a handle by which a user may grasp the applicator device 15 and exert adequate inwardly directed force to focus and control the application of treatment fluid to a desired automobile interior surface.

It is contemplated that the squeeze bottle container 22 depicted in the preferred embodiment of FIGS. 1–4 may be disposable and replaceable, containing any number of a variety of appropriate treatment fluids for application to an automobile's interior surfaces. The user may detach the squeeze bottle container 22 from its complementally mating applicator head 67 and discard it when it has exhausted its supply of fluid, while subsequently replacing the discarded bottle with a new and filled bottle. However, it is also contemplated that the squeeze bottle container 22 may be refillable by way of an outwardly and upwardly extending filling stem (not shown) projecting from the vicinity of the rear extremity of the dorsal wall 26. It is further contemplated that such a filling stem may include a snap on containment cap, a screw top or hinged construction or any other appropriate securement means (not shown) to prevent the escape of fluid from the reservoir 24.

The exterior surface of the container 22 need not be specifically ergonomically adapted, however, as shown in the preferred embodiment of FIGS. 1 and 2, at least the dorsal wall 26 may be shaped and adapted to correspond to the natural curve of a typical user's palm when he or she is grasping the container 22 as a handle, while the ventral wall 28 may be similarly shaped and oppositely disposed. In plan view, as shown in a preferred embodiment of FIG. 3, the convex dorsal wall 26 curves gradually outwardly and downwardly to define a palm pad 27 for complemental receipt in the correspondingly concavely curved palm of the user when his or her hand is in a grasping posture. This palm pad provides a pressure surface facing in one direction by which the user may grasp the applicator to exert an appropriate amount of force in the opposite direction for applying treatment fluid to a desired surface. It is further contemplated that other ergonomic features may be incorporated into the container 22 design, to include, for instance, finger grooves (not shown) for receipt of the user's fingers therein.

With focus now on the connection of the container 22 to the dispenser housing 70, as shown in FIGS. 1–3 and 7–8, the cowling 86 terminates in its rear edge in a scallop configured on its top and bottom sides with rearwardly projecting curved tongues 87 terminating in respective rearward edges 88. In one preferred embodiment, as shown in FIG. 24, a contoured groove is formed about the periphery of the end container wall 31 to define a forwardly facing contoured shoulder 32 curved on its opposite sides to receive in a nesting relationship the respective tongues 87. Also, as shown in FIG. 24, the end wall 31 of the container 22 may include a yoke 33 that extends from the lower extent of the shoulder 32 to define the portion of the container 22 that is received within the coupling assembly 145 of the housing 70. The yoke 33 is preferably centrally formed with the outwardly projecting neck 45 to be received in cavity 150 of the inlet device 148 (see FIGS. 14–15). The neck 45 may take any convenient corresponding shape to that of the cavity 150 for complemental receipt therein, and in one preferred embodiment as shown in FIG. 24, is internally hollowed along its length and cylindrical in shape. It is also contemplated that a bottle cap (not shown), which may take on a multiplicity of structures known in the art, may be releasably secured over the proximal end of the neck 45 to seal against the unwanted flow or evaporation of fluid from the container reservoir 24. A user may remove and discard this cap before mating the container 22 with the dispenser housing 70, or may retain it to be placed back on the neck 45 if the container 22 is removed from the applicator head 67 for storage between applications.

With continued reference to the preferred embodiment of FIG. 24, to enable mounting and locking of the container 22 into the inlet device 148 of the dispenser housing 70, the neck 45 is formed with a plurality of radially outwardly projecting locking studs 50. Such studs 50 are annularly arrayed about the neck 45 and spaced apart and sized to snapingly register behind corresponding lugs 162 (see FIGS. 14–15) in the inlet device 148 and to fit axially through the clearance slots 165 (see FIGS. 12–13). The studs 50 are further configured at their respective free extremities with outwardly and rearwardly angled cam surfaces 51. As shown in the preferred embodiment of FIGS. 12 and 13, the neck may be formed with three such studs 50 for coupling with three corresponding lugs 162 on the coupling shell 154, which are arrayed equidistant thereabout and spaced annularly apart by a distance to define respective clearance slots 165 therebetween, and to receive axially, in clearing relationship, the respective studs 50. As shown in FIGS. 14 and 15, such lugs 162 are configured with radially out turned teeth 163 defining inwardly and forwardly angled, outwardly facing cam surfaces 164 configured to slidingly engage the cam surfaces 51 of the studs 50 for axial shifting relative thereto and flexing to provide for axial travel sufficient to register the studs 50 behind the lugs 162 in locking relationship as shown in FIG. 15. So configured, the neck 45 will be received in the annular cavity 150 and over the inlet boss 160 such that, with the studs 50 engaged securely behind respective lugs 162, the distal portion of the neck 45 will be seated against neck abutment surface 157, as is shown in FIG. 15, and the neck 45 will be securely seated in inlet device 148 in a close fit relationship to provide a fluid tight sealing engagement between the container 22 and the housing 70. Thus, with the rearward edges 88 of the cowling tongues 87 nested against the forwardly facing shoulder 32 of the end wall 31, the neck yoke 33 received in the coupling assembly 145, the neck 45 seated against the abutment surface 157 and received over the inlet boss 160 and the studs 50 registered securely behind respective lugs 162, the container 22 will be securely registered within the housing to hold its rotary position therein.

To release the container 22 from the dispenser housing 70 and its coupling assembly 145, either the cowling 86 and/or cowling tongues 87 (see e.g. FIG. 2) or the yoke 33 and/or container end wall 31 (FIG. 30), or all of these elements, may be constructed of a material sufficiently flexible to permit sufficient limited axial rotation of the container 22 and the cowling 86 relative to one another to disengage the complemental mating of the forwardly facing shoulder 32 of the container 22 and the rearward edges 88 of the curved cowling tongues 87. This simultaneously rotates the neck 45 within the coupling shell 154 from the position shown in FIG. 12, with the studs 50 snapingly engaged behind corresponding lugs 162, until the locking studs 50 are aligned with respective clearance slots 165, as shown in FIG. 13. The user may then withdraw the studs 50 axially through the slots 165 to effectuate a separation of the neck 45 from the inlet device 148. It is also contemplated that, to disengage the container 22 from the housing 70, the cowling 86 and container 22 may be manufactured such that, when the yoke 33 is received in the cowling 86 and the cowling tongues 87 are aligned with the container shoulder 32, there is sufficient clearance between the shoulder and the tongues and the yoke and the cowling to permit limited axial rotation of the container 22 relative to the housing 70.

While a snap lock connection has been described, it is contemplated that any appropriate connection means, such as a bayonet fit, threaded engagement or a clamp type connection, may be employed in the coupling assembly 145 to facilitate coupling of the container 22 to the dispenser housing 70. For example, the coupling shell 154 may be configured with a peripheral connector bead section (not shown) while the neck 45 is formed with an exterior conically shaped flange (not shown) for snapping behind this connector bead section. It is also contemplated that female threading in the coupling shell 154 may receive male threads formed on the neck 45, or that male threads on the periphery of the inlet boss 160 may be received in female threading on the interior of the neck 45. Additionally, while the container 22 has been shown as including a projecting tubular neck 45 for receipt in the coupling assembly 145 of the housing 70, it will be appreciated by those skilled in the art that the term neck is intended to include any opening in the container, including a recessed tubular element, it only being important that the construction of the neck permit complemental mating of the housing 70 and the container 22.

In operation, it will be appreciated that the applicator of the present invention will typically be sold at a retail level in a package including the applicator head 67 and container 22, possibly along with one or two replacement containers. The replacement containers will typically be closed by a cap (not shown) releasably connected to the container's neck 45 by any suitable means known in the art. To assemble the applicator device 15, the user will mount a chosen container 22 in the applicator head 67 by generally inserting the yoke 33 and end wall 31 of the container 22 into the coupling assembly 145 of the housing 70. More specifically, the snap lock construction included in the coupling assembly 145 of the preferred embodiment shown in FIGS. 12–15 permits the user to seat the container neck 45 in the inlet device 148 in a close fit, fluid tight sealing relationship, by inwardly advancing the neck 45 through the cavity 150 within the coupling shell 154 and over the inlet boss 160 until the neck studs 50 are snapingly engaged behind respective lugs 162 and the distal extent of the neck 45 is seated against the neck abutment surface 157. This serves to align the mating curvilinear rearward edges 88 of the cowling tongues 87 with the forwardly facing shoulder 32 of the end wall 31 as shown in FIG. 8, while the yoke 33 and end wall 31 of the container are seated in the coupling assembly 145 and the neck 45 is received in the inlet device 148 as described above and shown in FIG. 7.

When the user undertakes to use the applicator, he or she will grasp the container 22, hold the head 67 down, and either shake such container or exert inwardly directed compressive force on the walls thereof to reduce the volume of the reservoir, applying pressure to the applicator fluid therein to drive such fluid downwardly along fluid communication path 130 through the boss 160 (FIG. 7) and downwardly into the flow chamber 71. In this regard, it will be appreciated that by pointing the housing 70 downwardly, the fluid will travel into the flow chamber 71 and along the communication path 130, which will apply pressure to the flow control valve 133. With the flow chamber 71 and inlet boss 160 filled, by compressing the walls of such container 22 and reducing the volume therein, pressure will be applied to the fluid in the flow chamber 71, thus tending to force it through control valve 133 (FIGS. 10–11). As further pressure is applied thereto, the valve's domed shape will be deflected downwardly in the center, thus flaring the proximate corners of the leaves 138 downwardly, thereby opening the slits 136 and providing for a flow of treatment fluid downwardly through the distribution plate 75 and distribution surface 76 to the applicator pad attachment surface 56. A portion of the deposited fluid will begin to flow through the applicator pad 55, while the remaining fluid begins to flow through the channel 91 to travel forwardly and rewardly therein, as shown in FIGS. 7–8, so that fluid is distributed across the lateral and/or longitudinal dimensions of the applicator pad 55 for passage therethrough to the working surface 62.

The user will then grasp the container handle 22 to gain favorable purchase of the applicator 15 and may move the handle as desired to pass the head 67 of the applicator across the surface to be treated, thus applying fluid reaching the underside working surface 62 to the treatment surface. The handle container 22 serves to extend the reach of the applicator 15, and in practice, the applicator head 67 is about 4 inches long and the container 22 about 6 inches long to provide an overall axial reach of some 10 inches. By grasping the container 22 and thrusting the tapered head forwardly, the operator may conveniently access, for instance, the surface of automobile dashboard, even forwardly into the triangular volume formed between the generally horizontally rearwardly projecting dashboard surface and interior of the rearwardly upwardly sloped windshield. If desirable, when the interior surface of the door or like areas are being treated, the user may conveniently grasp the dispenser housing 70 from the top side thereof, applying the palm of his or her hand to the domed surface thereof, to thus there apply more direct perpendicular forces against the applicator pad 55 to increase the application force on the working surface 62 and the polishing and application effect thereof.

It will be appreciated that the forwardly projecting finger 57 (FIG. 1) of such applicator pad 55 and/or the peripheral skirts 58 will compress from the bottom and top sides to conform to the contours of the areas being accessed to thus allow the user to reach even the most narrow area between, for instance, the windshield and dashboard surface. Additionally, when the user engages the working surface 62 of the pad 55 with a desired treatment surface, the pad 55 is flexible to flex and cooperate with working surface 62 to conform to the shape and curvature of the chosen treatment surface. This will permit the user to evenly spread the desired fluid onto the treatment surface by applying a substantially even pressure across the length of the working surface 62. It will be appreciated that further downward pressure on the applicator head 67 will facilitate the tendency to force the liquid through such pad 55 to the working surface 62 and to the surface being treated. When the initial charge of fluid dispensed has been depleted, the user may thereupon squeeze the container 22 or otherwise again repeat the above described sequence.

When the procedure is completed, the user may easily disconnect the container 22 from the dispenser housing 70 and coupling assembly 145 by twisting the container 22 to rotate container end wall 31 within the cowling 86. The flexibility of the cowling 86, curved tongues 87, yoke 33 and/or end wall 31 will permit limited axial rotation to skew the alignment between the end wall 31 of the container 22 and the curved tongues 87 of the cowling 86, thereby disengaging the forwardly facing shoulder 32 of the container 22 from the rearward edges 88 of the tongues 87. This simultaneously permits the user to similarly rotate the neck 45 slightly within the coupling shell 154 and cavity 150 from the position shown in FIG. 12, with the studs 50 snapingly engaged behind respective lugs 162, until the locking studs 50 are aligned with respective clearance slots 165, as shown in FIG. 13. The user may then withdraw the studs 50 through the slots 165 to effectuate a separation of the container 22 from the housing 70.

A cap (not shown) may then be replaced on the neck 45 of the container 22 to be stored until the next use, and, if desirable, the applicator pad 55 may be cleaned or washed in a cleaning fluid, such as tap water. The container 22 and applicator head 67 may then be readily assembled for the next usage, or when the fluid in such container becomes diminished, the container 22 may be discarded and a new replacement container 22, already charged with a desired fluid, may be selected and secured in the dispenser housing 70 as set forth above. It is contemplated that the user may replace the depleted container with another of the same type container for treatment of a similar surface, or may select a different container having appropriate treatment fluid for application to a different treatment surface.

Figure 16:
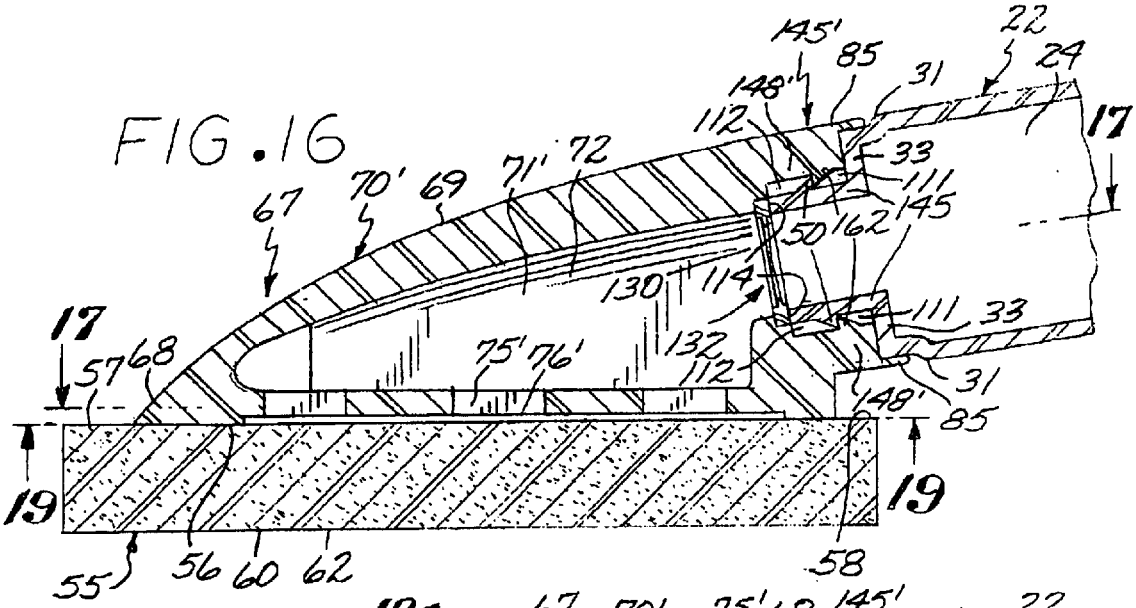
FIG. 16 is a longitudinal sectional view of a second embodiment of the applicator device of the present invention.

Turning now to an alternate preferred embodiment as depicted in FIGS. 16–19, it is also contemplated that a distribution plate 75' may be formed with a plurality of through flow openings 100 arrayed across the longitudinal and lateral extent thereof. As shown in FIG. 16, in this preferred embodiment, a housing 70' is formed with a flow chamber 71'. The flow chamber 71' may also include a multiple chamber internal construction, being divided into a plurality of chambers, for example two, or, in the embodiment depicted in FIG. 8, a central introduction chamber 72 may be disposed between a pair of flanking chambers 73. However, it is also contemplated that the fluid may pass through the flow chamber 71' to a distribution manifold (not shown), which in turn distributes fluid to a plurality of transfer channels for distributing the fluid across the dimensions of the attachment surface 56 and through the applicator pad 55 to its working surface 62.

Figure 17:
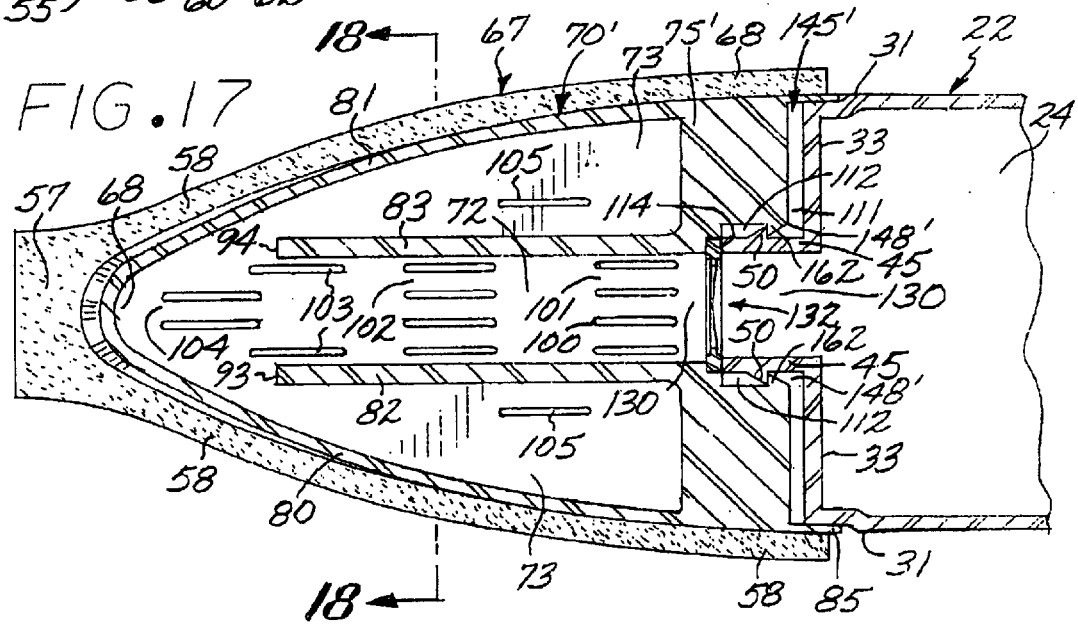
FIG. 17 is a horizontal sectional view of the applicator device shown in FIG. 16 taken along line 17—17 of FIG. 16.

With continued reference to the preferred embodiment depicted in FIG. 17, in a tripartite multiple chamber embodiment, the chamber 71' may be configured with a pair of elongated laterally spaced apart ribs, 82 and 83. In this embodiment, the housing 70' includes a rear wall 85, and the ribs, 82 and 83, emanate from the rear wall 85, projecting forwardly to form a centrally disposed introduction chamber 72 and to terminate at their respective forward extremities in respective outlet edges 93 and 94 spaced rearwardly of the laterally disposed converging sidewalls 80 and 81 of the housing 70'. Within the flow chamber 71', these ribs, 82 and 83, not only define the introduction chamber 88, but their lateral edges also define the inner walls of a pair of laterally spaced apart flanking chambers 73 having the introduction chamber 72 disposed therebetween. The top surface of the distribution plate 75' defines the bottom surface of the flow chamber 71' and any other chambers included therein.

In a preferred embodiment as shown in FIGS. 16–17, the introduction chamber 72 angles downwardly and forwardly from the proximal extremity of the housing 70' to terminate near the distal extremity, but may extend in any appropriate angle or configuration to facilitate the desired distribution of fluid through various locations in the distribution plate 75'. While fluid distribution to the distribution plate 75' will generally be influenced by the pressure created by inwardly directed compressive forces on the walls of the container, the longitudinal alignment of the introduction chamber 72 may also influence the flow path of the fluid to the distribution plate 75'. For example, a greater downward and forward angling introduction chamber 72 permits the fluid to flow more to the distal extremity of the housing 70', while a lesser downward and forward angling permits the fluid to flow more predominantly to the vicinity of the proximal extremity.

Figure 19:
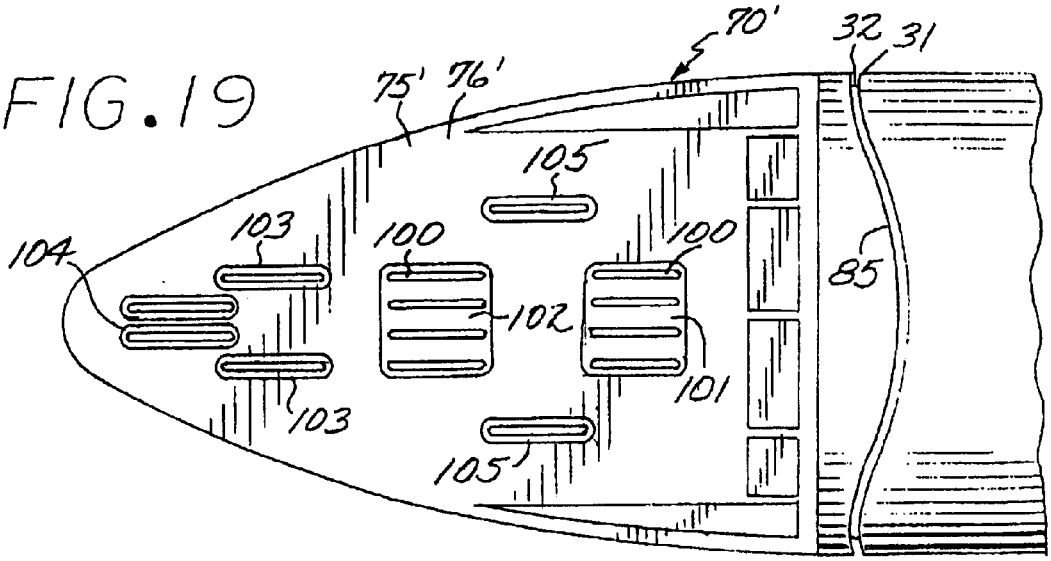
FIG. 19 is a horizontal sectional view taken along line 19—19 of FIG. 16.

With reference to the preferred embodiment of FIG. 17 wherein the distribution plate 75' is formed with selected arrays of flow openings 100, these openings are strategically placed to distribute a metered and relatively predictable amount of treatment fluid therethrough to the applicator pad 55. In FIGS. 17 and 19, the openings appear as elongated slots 100, but may take any convenient shape or dimension to accommodate the material characteristics of the product being dispensed or the contours of the desired treatment surface. For instance, more viscous fluids will require larger openings. Also, smaller, hard to reach surfaces may require that there be more product near the distal extremity of the housing 70' for dispensation through the applicator pad 55 near the distal tip thereof, thereby necessitating relatively more or larger openings 100 in the vicinity of the distal extremity of the distribution plate 75' than near the proximal extremity.

With continued reference to a preferred embodiment as shown in FIG. 17, a plurality of slots, generally designated 100, are arrayed in the distribution plate 75' and may be grouped in a first and second set of longitudinally spaced apart slots, 101 and 102 respectively, which are generally situated in the introduction chamber 72 near the central region of the dispenser housing 70'. As will be appreciated by those skilled in the art, such relatively closely spaced and clustered slots, as shown in FIG. 17, are so configured to provide for the dispensation of a relatively robust quantity of fluid located generally centrally over the applicator pad 55 in the wider area thereof so as to afford a relatively robust quantity of dispensed fluid in that wide area for distribution and application to the desired interior automobile surface. It is contemplated that in one preferred configuration, these slots may be approximately 1/16" wide and 3/8" long for effective use in conjunction with a variety of commercially available multi-purpose protectant fluids. Other suitable treatment fluids may require appropriate adjustment in the dimensions of the slots 100 for optimal flow characteristics therethrough based on the material composition of the selected fluid. With ongoing reference to the preferred embodiment of FIG. 17, disposed centrally near the distal extremity of the housing 70', toward the forward extremity of the distribution plate 75', are less densely clustered through slots 100 with one pair 103 being laterally spaced about 3/8" apart and a forwardly disposed pair 104 spaced laterally at about 1/4" apart to thus provide for a less robust distribution of fluid at the more narrow forwardly disposed locations of the distribution plate 75' near its distal extremity. As further shown in the preferred embodiment of FIG. 17, spaced generally centrally in the rearward portion of the flanking chambers 73, are single slots 105 so disposed to provide for a relatively modest flow of fluid in the lateral portions of the wider segment of the applicator pad 55.

Figure 18:
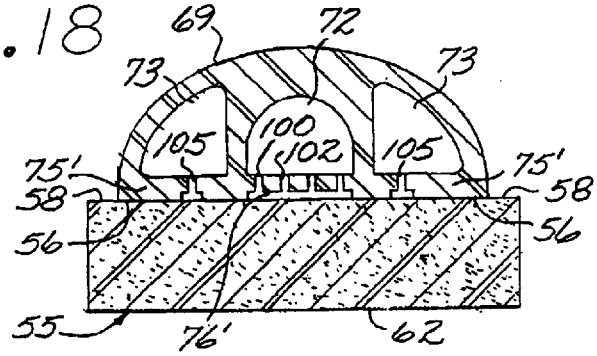
FIG. 18 is a transverse sectional view taken along line 18—18 of FIG. 17.

The distribution plate 75' may be formed such that the openings 100 extend from the upper surface and terminate at a distribution surface 76'. In such an embodiment, the applicator pad attachment surface 56 is strategically affixed to the distribution surface 76' throughout its surface area by adhesive or other suitable affixation means known in the art, ensuring that the affixation means does not clog or otherwise occlude the openings 100. To further ensure that the openings will not be occluded by the adhesive or other affixation means, the distribution surface 76' of the distribution plate 75' may be recessed, as shown in FIGS. 18–19, so that the openings 100 terminate in the distribution surface 76' of the distribution plate 75' at a point spaced apart from and above the pad attachment surface 56. It is further contemplated that the outer perimeter of the bottom surface of the distribution plate 75' may be formed with a downwardly projecting mounting ridge (not shown) for affixation of a corresponding in area portion of the perimeter of the applicator pad attachment surface 56 thereto.

With focus now on the internal construction of the housing 70' in the alternate embodiment shown in FIGS. 16–17, it is also keeping with the invention that the rear dispenser housing wall 85 may be formed with a coupling assembly 145' (FIG. 17) including a mounting socket 111 for complemental mating with the neck yoke 33 and neck 45 of the container 22. The mounting socket 111 is formed with an inlet device 148', which in this preferred embodiment includes a tubular inlet bore 112 that extends forwardly and downwardly through the rear wall 85 and maintains fluid communication with the flow chamber 71'. The inlet bore 112 is formed with at a bore abutment ridge 114 extending inwardly from the walls of the bore 112 and defining a transition between the distal extent of the inlet bore 112 and the proximal extent of the flow chamber 71'. In FIGS. 16–17, the flow control 132 is depicted as being located at this transition, however, it may be located at any point along fluid communication path 130 from the container 22 to the applicator pad 55. As shown in FIGS. 16 and 17, when the container 22 is received in the inlet bore 112, the distal extremity of the neck 45 will be abutted against this abutment ridge 114. In such a preferred embodiment, the abutment ridge 114 is annular in shape, having a central opening defining a portion of the fluid communication path 130 for passing the fluid therethrough from the container 22 and its neck 45 to the flow chamber 71'.

As set forth in the above described embodiment, the bore 112 may be further formed in its proximal region with a plurality of lugs 162 spaced apart to define clearance slots 165 therebetween such that the studs 50 of the container neck 45 will be snapingly engaged behind respective lugs 162 in the bore 112 to secure the container 22 to the housing 70' and its coupling assembly 145'. While a snap lock connection has been described, it is further contemplated that any appropriate connection means, such as a threaded engagement or a clamp type connection, may be employed to facilitate coupling of the container 22 to the dispenser housing 70'.

In operation, the user will secure the container 22 in the coupling assembly 145' of the dispenser housing 70' by aligning the yoke 33 in the mounting socket 111 and seating the container neck 45 in the inlet bore 112 to thereafter inwardly advance the neck 45 through the inlet bore 112 in an alignment such that the locking studs 50 will be secured behind respective lugs 162 as set forth above. This will also result in the alignment of the mating curvilinear surfaces of the cowling 86 and the container end wall 31. As shown in the preferred embodiment of FIGS. 16–17, by squeezing inwardly the walls of the container 22, a user will then cause the fluid therein to flow from the container reservoir 24, through the inlet bore 112 and neck 45, and to the flow chamber 71', and more specifically, to the outwardly and forwardly angled rear portion of the introduction chamber 72. This initially directs the flow of fluid over the rear most array of slots 101 into contact with the longitudinally medial portion of the distribution plate 75', and will further effect flow through the second set of slots 102 for dispensation therethrough. Fluid flow will then continue to the more forwardly positioned and laterally spaced slots 103 for a laterally spaced dispensing thereof, and further to the forward more closely spaced slots 104. The fluid flow, under continued pressure from the squeezed container 22, will then continue forwardly and spread laterally across the forwardly disposed respective outlet edges 93 and 94 of the corresponding ribs 82 and 83 to flow laterally, outwardly and rearwardly into the respective flanking chambers 73, to then be driven rearwardly under pressure to flow over the slots 105 to thus dispense a measured modest amount of fluid to the lateral most portions of the distribution plate 75'.

With reference to FIGS. 17–19, as the fluid is forced to the various slots 100–105 of the distribution plate 75', it then continues through such slots in such distribution plate to the distribution surface 76', which may be recessed and spaced apart from the applicator pad 55 to prevent occlusion of the slots. The fluid will then flow to the attachment surface 56 of the applicator pad 55, and then through the applicator pad 55 or through channels 59 formed therethrough to be dispersed on the applicator working surface 62. The user then may pass the head of the applicator across the surface to be treated thus applying the underside working surface 62 of the pad 55 thereto. When the readily available supply of fluid at the working surface 62 has depleted, the user may thereupon squeeze the container 22 or otherwise again repeat the above described sequence. After treatment of a desired surface is completed, or the fluid in the container 22 has been exhausted, the user will rotate neck 45 in inlet bore 112 to align the studs 50 with a corresponding clearance slot 165. He or she may then withdraw these studs 50 through the clearance slots 165 to effectuate release of the container 22 from the housing 70', and replace the container 22 as set forth above.

While a squeeze dispensing embodiment of the container 22 has been described in detail, it is also in keeping with the invention to choose a material for the container having relatively more rigid walls, thereby requiring the user to vertically elevate the container 22 and handle 24 portion of the applicator 15 above that of the housing 70 in order to initiate the flow of fluid into the housing 70 and applicator pad 55. Further, the handle may not necessarily be defined by the container 22, but may be formed as one of two or more components. For example, the handle may be in the form of an open top channel shaped member, while the container may be in the form of a flexible bottle, tube or other devices readily known to those skilled in the art wherein the volume can be varied as by flexing the wall or rolling up the tube or depressing a plunger. Additionally, while the container neck 45 has been described as having a plurality of studs 50 for snapping engagement behind a corresponding plurality of lugs 162 as may be formed in the coupling shell 154, inlet device 148, inlet bore 112 or socket 111, it is contemplated that coupling of the container 22 to the housing 70 may also be accomplished by one such stud being received behind one such lug, or by any other convenient coupling construction as is known in the art. While several particular forms of the invention have been illustrated and described, it will also be apparent to those skilled in the art that various modifications can be made without departing from the spirit and scope of the invention. Accordingly, it is not intended that the invention be limited except by the following claims.

What is claimed is:

1. An applicator for dispensing treatment fluids to various surfaces, such that found in the interior of an automobile, and comprising:

a housing formed with a flow chamber and having one side thereof formed with an elongated distribution plate through which is formed a flow outlet for communicating fluid from the flow chamber to an outwardly facing distribution surface, the housing further including a coupling assembly that includes an inlet to the chamber and a first connector element;

an elongated pad mounted on one side to the distribution surface at an interface and being porous for flow of fluid therethrough to a working surface formed on the opposite side;

a container including an outlet neck configured to engage in the inlet to thereby establish a fluid flow path for communication of fluid from the container and through the inlet, flow chamber, distribution plate and flow outlet, the container further including a second connector element releasably engagable with the first connector element;

a fluid distribution device interposed at the interface and in fluid communication with the outlet to distribute the fluid longitudinally along the one side for flow through the pad to the working surface; and a flow control device located in the fluid flow path for regulating the flow of fluid therethrough.

2. The applicator of claim 1 wherein:

the fluid distribution device is further configured to distribute the fluid laterally along the pad.

3. The applicator of claim 1 wherein:

the flow control device includes a valve.

4. The applicator of claim 1 wherein:

the flow control device includes a one way valve responsive to a predetermined pressure in the flow chamber to provide for fluid flow therethrough.

5. The applicator of claim 1 wherein:

the inlet includes a tubular boss in communication with the flow chamber; and the neck of the container is constructed to be telescopically received over the boss.

6. The applicator of claim 1 wherein:

the neck of the container includes at least one stud defining the second connector element; and the inlet includes the first connector element which is formed with at least one lug for connecting with the at least one stud.

7. The applicator of claim 6 wherein:

the first connector includes at least one clearance slot corresponding in shape to that of the at least one stud; and the neck is constructed so the container may be grasped to rotate the neck to align the at least one stud with the clearance slot for axial withdrawal therethrough to release the second connector element from the first connector element.

8. The applicator of claim 1 wherein:

the inlet is further formed with a tubular boss and a coupling shell disposed thereabout to define therebetween an annular cavity, the shell further including at least one lug defining the first connector element; and the neck is telescopically received in the annular cavity and over the tubular boss and includes at least one stud defining the second connector element for connecting with the at least one lug.

9. The applicator of claim 1 wherein:

the first and second connector elements are constructed to allow rotation of the container about a rotational axis relative to the housing, and upon such rotation, the first connector element will be disengaged from the second connector element.

10. The applicator of claim 1 wherein:

the coupling assembly includes a cowling configured on at least one side with a tongue terminating in a registration edge; and the container includes an end wall configured with a shoulder facing such cowling to compliment the shape of the edge to abut thereagainst to register the container relative to the housing.

11. The applicator of claim 10 wherein:

the coupling assembly includes a cowling configured to receive the container in close fit relationship to resist rotation thereof and is sufficiently flexible to, upon application of predetermined rotational forces thereto, permit limited rotation thereof.

12. The applicator of claim 11 wherein:

the first and second connector elements are constructed so that the container can be rotated relative to the housing to disengage the elements from one another.

13. The applicator of claim 1 wherein:

the housing includes a flexible cowling projecting toward the container and configured to complementally engage the container to resist rotation of the container relative to the housing, the cowling being sufficiently flexible to flex and, upon predetermined rotational forces being applied to the container, permit rotation of the container relative to the housing.

14. The applicator of claim 1 wherein:

the pad projects laterally outwardly on the opposite lateral sides of the distribution plate to form flexible skirts.

15. The applicator of claim 1 wherein:

the housing includes a rearward region and a forward region, the forward region including a nose section; and the pad projects forwardly beyond such nose section to define a resilient finger.

16. The applicator of claim 1 wherein:

the distribution device includes at least one distribution channel formed on the distribution surface.

17. The applicator of claim 16 wherein:

the at least one distribution channel is further formed with at least one laterally outwardly extending distribution branch.

18. The applicator of claim 1 wherein:

the distribution device includes at least one distribution channel formed on the one side of the pad.

19. The applicator of claim 18 wherein:

the at least one distribution channel includes at least one laterally outwardly extending distribution branch channel.

20. The applicator of claim 1 wherein:

the pad includes a plurality of channels extending from the interface through the pad to facilitate the flow of fluid to specific desired points on the working surface.

21. The applicator of claim 1 wherein:

the housing is laterally formed adjacent to the distribution plate with a pair of oppositely disposed, outwardly projecting support wings.

22. The applicator of claim 1 wherein:

the container and the housing are configured for complemental mating to releasably hold the container against rotation about a rotational axis from a first rotational position with the first and second connector elements in axial alignment with one another, and further configured to, upon application of rotational forces thereto, permit the container to be rotated about the axis to move the first and second connector elements out of axial alignment.

23. The applicator of claim 1 wherein:

the distribution device includes a distribution manifold connecting a plurality of channels that extend laterally outwardly in the distribution plate and distribution surface.

24. The applicator of claim 1 wherein:

the distribution plate includes a plurality of dispenser openings arrayed about the lateral and longitudinal dimensions of the plate to define the distribution device and the flow outlet.

25. The applicator of claim 1 wherein:

the flow chamber is formed adjacent to the inlet and further comprises a pair of laterally spaced apart, longitudinally extending distribution ribs defining a central introduction chamber therebetween respective laterally flanking chambers in fluid communication with such central introduction chamber.

26. The applicator of claim 25 wherein:

the distribution plate defines a bottom surface of the central chamber and flanking chambers and includes a plurality of flow openings arrayed thereabout to define the distribution device and the flow outlet.

27. The applicator of claim 26 wherein:

the distribution plate is formed with at least a central set of elongated flanking flow openings spaced longitudinally along the central introduction chamber and at least one elongated flow opening formed in each of the flanking chambers.

28. The applicator of claim 1 wherein:

the container includes an end wall formed with the neck; and the coupling assembly includes a mounting socket for receiving the end wall therein, the mounting socket being formed with an inlet bore for telescopic receipt of the neck.

29. The applicator of claim 28 wherein:

the inlet bore is formed with an abutment ridge for abutting the neck thereagainst when the container is received in the housing.

30. An applicator for dispensing treatment fluids to a selected surface, such that found in the interior of an automobile, comprising:

a housing head having a front and a rear extremity and including a distribution plate formed with a distribution surface, a receiver opening upwardly towards the rear extremity and a flow passage leading from the receiver to the distribution surface, the receiver being further formed with a first connector and an inlet tube;

the distribution plate further including a longitudinal distribution channel in communication with the passage and opening into the distribution surface;

an elongated applicator pad mounted on one side to the distribution surface and formed on its opposite side with a working surface, the pad being porous for flow of the fluid from the distribution channel to the working surface;

a one way valve in the passage for controlling the flow of fluid therethrough;

a flexible wall fluid package including a neck telescopically receivable in the receiver over the inlet tube and including screw thread segments releasably engagable with a screw cap received on the neck and a second connector releasably engagable with the first connector whereby the fluid may be packaged in the package, the cap may be removed and the neck may be inserted in the receiver and over the inlet tube to couple the second connector element with the first connector element and establish a flow path from the package, through the receiver, through the valve, through the flow passage, and to the distribution channel, such that upon squeezing of such flexible wall, the fluid will be flowed from the container to the working surface.

31. The applicator of claim 30 wherein:

the package is formed with a shoulder; and the head includes a cowling projecting toward the package and terminating in abutment edges engaging the shoulder to cooperate with the neck and receiver in supporting the package relative to the head.

32. The applicator of claim 30 wherein:

the plate includes at least one lateral distribution channel in communication with the longitudinal distribution channel.

33. An applicator for dispensing treatment fluids to a selected surface, such that found in the interior of an automobile, and comprising:

an applicator head having a front and a rear extremity and formed with an interior flow chamber for receiving the treatment fluid and an exterior hand pressure surface facing in one direction, the head further including an elongated distribution plate formed with a passage means for passing the fluid therethrough to a distribution surface facing in the opposite direction and an inlet device in communication with the flow chamber including a first connector element and a tubular inlet boss;

a fluid container for storing the fluid and including a neck for engagement with the inlet device and telescopic receipt over the boss and a second connector element for connecting with the first connector to releasably secure the container in the applicator head;

a flexible pad affixed to the distribution surface to define an interface and being sufficiently porous to permit the communication of fluid therethrough to a working surface facing in the opposite direction, said pad constructed to, upon the hand pressure surface being grasped by a user, engage the working surface with the selected surface for the application of a selected force in the opposite direction toward the selected surface to apply fluid from the working surface to the selected surface;

a flow device to be activated by the user to drive the fluid to flow along a fluid communication path defined by the container neck, the boss, the flow chamber and the distribution plate and passage means; and a distribution device interposed at the interface for receiving the fluid from the passage means and including at least one longitudinal channel for distributing the fluid longitudinally along the applicator pad.

34. The applicator of claim 33 that includes:

a flow control means positioned in the fluid communication path for controlling the flow of fluid therethrough.

35. The applicator of claim 33 wherein:

the distribution device further includes at least one lateral distribution channel for distributing the fluid laterally along the applicator pad.

36. A method of using an applicator for applying treatment fluids to a selected surface, such that found in the interior of an automobile, comprising:

selecting an applicator device including a flexible wall container having a neck and containing the treatment fluid, a hand pressure surface facing in one direction, a housing including an inlet for engaging with the neck to releasably mount the container in the housing and further including a distribution plate formed with a distribution surface facing in the opposite direction, a fluid communication path formed between the container, the inlet and the distribution surface, a one-way flow control device for controlling the flow of fluid along the fluid communication path, a flexible applicator pad attached on one side to the distribution surface at an interface and being sufficiently porous to flow fluid therethrough to an opposite side formed with a working surface facing in the opposite direction, and a distribution device interposed at the interface for distributing the fluid from the distribution surface across the area of the one side of the pad;

flexing the flexible wall container to cause the fluid to flow under pressure along the fluid communication path and through the flow control device to the distribution device to be distributed about the area of the pad and flow therethrough to the working surface; and treating the tire sidewall by grasping the hand pressure surface facing in the one direction, engaging the working surface with the selected surface and applying a selected force in the opposite direction toward the selected surface, thereby applying the fluid on the working surface to the selected surface.

37. The method of claim 36 including:

selecting the flexible wall container having the hand pressure surface formed thereon.

38. The method of claim 36 including:

selecting the housing with the hand pressure surface formed thereon.

39. An applicator device for dispensing treatment fluids to an interior surface, such that found in an automobile, and comprising:

an elongated housing including a flow chamber, an inlet device and an elongated distribution plate formed with a through opening leading to an exterior distribution surface and at least one distribution channel for communicating fluid longitudinally along the plate;

the inlet device further including a coupling shell circumscribing an inlet tube to define therebetween an open ended annulus and a coupling wall formed with an abutment surface, the coupling shell further being formed with a plurality of radially inwardly directed snap fit lugs spaced annularly apart to form respective clearance slots therebetween;

a flexible pad mounted on the distribution surface on one side at an attachment surface for receiving fluid from the distribution channel and formed on the opposite side with a working surface, the pad being constructed to, when the plate is pressed toward the interior surface, flex and cause the working surface to engage the interior surface, the pad further being sufficiently porous for flow of the fluid from the attachment surface to the working surface;

an elongated squeeze wall container for containing the fluid received in the housing and including an outlet neck configured to be telescopically received over the inlet tube into the annulus and abutted against the abutment surface, the neck including a plurality of studs spaced equidistant thereabout and constructed for snap fit connection with the lugs, such container being rotatable relative to the coupling shell to register the studs with the clearance slots for axial sliding therethrough for disconnecting the container from the housing; and an indexing device for normally holding the container relative to the housing to maintain the studs and lugs in axial alignment with one another and operative upon forced rotation of such container to provide for relative rotation between the housing and container to align the studs with the clearance slots.

* * * * *